US006095874A

United States Patent [19]

Quaranta

[11] Patent Number: 6,095,874

[45] Date of Patent: Aug. 1, 2000

[54] SINGLE PIECE ELECTRICAL RECEPTACLE TERMINAL

[75] Inventor: Frederic Quaranta, Bobigny, France

[73] Assignee: The Whitaker Corporation, Wilmington, Del.

[21] Appl. No.: 09/317,065

[22] Filed: May 12, 1999

[30] Foreign Application Priority Data

May 18, 1998 [EP] European Pat. Off. ..... 98401196

[51] Int. Cl.[7] ..... H01R 11/22

[52] U.S. Cl. ..... 439/852; 439/843; 439/851

[58] Field of Search ..... 439/852, 851, 439/850, 849, 845, 842, 843, 856, 857, 948

[56] References Cited

U.S. PATENT DOCUMENTS

| | | | |
|---|---|---|---|
| 3,601,785 | 8/1971 | Longenecker et al. | 439/850 |
| 3,853,389 | 12/1974 | Occhipinti | 439/852 |
| 4,032,215 | 6/1977 | Jarmofsky et al. | 439/852 |
| 4,120,556 | 10/1978 | Waldron et al. | 439/948 |
| 4,148,547 | 4/1979 | Otsuki et al. | 439/843 |

FOREIGN PATENT DOCUMENTS

| | | |
|---|---|---|
| 0 125 927 | 11/1984 | European Pat. Off. . |
| 2 751 793 | 1/1998 | France . |

*Primary Examiner*—Gary F. Paumen
*Assistant Examiner*—Tho D. Ta

[57] ABSTRACT

A single piece electrical receptacle terminal comprises a contact section in the form of a box having a front wall and short mating end side wall portions extending from the front wall. The side wall portions assist in providing a robust box and protect the contact area, yet require little material and generate little scrap.

11 Claims, 3 Drawing Sheets

SINGLE PIECE ELECTRICAL RECEPTACLE TERMINAL

BACKGROUND OF THE INVENTION

1. Field of the Invention

This invention relates to a single-piece stamped and formed electrical receptacle terminal.

2. Description of the Prior Art

In many applications in the electrical industry it is a continuous requirement to provide more cost-effective yet more compact, sturdy and reliable electrical terminals. It is common to find electrical terminals stamped and formed from sheet metal that have a connection section such as a crimp barrel for connection to a conducting wire, further comprising a contact section for connection to a complementary terminal, and means for securing the terminal within the cavity of a connector housing. It is common to find receptacle terminals for mating with tab or pin terminals to have resilient cantilever beam contact arms extending from opposed sides of the terminal to receive the complementary pin or tab therebetween. In certain applications, an additional outer spring body stamped and formed from a stronger material such as stainless steel is positioned around the contact section of the terminal and serves to provide means for securing the terminal within the connector housing and extra spring support for increasing the spring strength of the inner contact arms. Such an outer spring body often has the effect of protecting the inner contact area thus making the receptacle terminal more robust, but also increases the contact pressure and provides a stronger support for securing of the terminal in a connector housing.

A two part terminal is however costly to produce, in comparison to a one-piece terminal, for example as shown in U.S. Pat. No. 4,148,547. The latter terminal does not however have an outer cage that is robust because side and tops walls are separate from each other. Furthermore the outer cage side walls require a long strip of sheet metal leading to a lot of material waste. A single piece terminal with a more robust outer cage is shown in European patent EP 125927B where cantilever beam contact arms are folded into the cage from the top wall seam. Here also, there is high material wastage because the width of the layout of the crimping barrel is much less than the cage and contact arm section.

A terminal according to French patent application 2 751 793 overcomes certain of the aforementioned problems by reducing material usage and providing a well protected inner receptacle contact section in a single piece design. The cantilever beam contact arms are protected from the effects of false insertion of a mating pin terminal by provision of a front wall that guides and locates a mating pin terminal during insertion into the receptacle terminal. The front wall also serves to provide inwardly stamped extensions or tabs against which the cantilever beam contact arms resiliently abut in order to pre-stress the contact arms thereby increasing the contact force against a mating terminal. The terminal described in this reference also has the advantage of being easily inserted through a seal without damaging the seal. Despite these improvements, it would be desirable to further improve single piece receptacle terminals, particularly in view of reducing material usage and scrap, without compromising robustness and electrical contact properties. It would be further desirable to provide a particularly compact single piece electrical terminal with a well protected contact area. It would be further advantageous to ensure that such terminals can be securely retained in connector housings.

SUMMARY OF THE INVENTION

It is therefore an object of this invention to provide an improved single piece stamped and formed electrical receptacle terminal.

Disclosed herein is a single piece electrical receptacle terminal for mating with a complementary tab or pin terminal, the terminal stamped and formed from sheet metal and comprising a connection section and a contact section comprising a contact body with top, side and bottom walls forming a box-shape defining an inner cavity area for receiving the mating terminal therein, the contact section further comprising cantilever beam contact arms extending from the opposed side walls and having contact portions arranged proximate a mating end wall at a mating end of the terminal, the mating end wall provided with a cutout for guiding and locating the mating tab or pin terminal into the inner cavity area and between the contact arms, wherein the side walls comprise mating end portions attached and extending from opposed side edges of the mating end wall and folded substantially orthogonally therefrom in order to be arranged along sides of the contact section, the side wall mating end portions comprising locking shoulders for locking the terminals in a connector housing, the locking shoulders positioned approximately over the contact portion of the contact arms.

Advantageously therefore, the layout of sheet metal from which the single piece electrical terminal is formed is compact thereby requiring little material usage and scrap, in view of provision of the mating wall side portions extending from side edges of the mating end wall. Nevertheless, a compact and well protected contact area is provided by extension of the mating end side wall portions to the region of the contact arm contact portions. Secure and reliable locking of the terminals within connector housings is ensured in a simple manner by the locking shoulders provided on the mating end side wall portions.

The mating end side wall portions may be secured to the top or bottom walls by welding, for example laser welding, in order to provide a compact yet rigid mating end portion of the contact section. In order to further rigidify the box-shape mating end portion of the contact section, the top or bottom walls and the mating end side wall portions may be provided with interleaving extensions projecting transverse to the terminal mating direction. The interleaving extensions thus also securely hold the mating end wall of the terminal to the top, bottom and side walls. The mating end wall may be folded from the bottom wall substantially orthogonally thereto whereby the interleaving extensions of the mating end side wall portions co-operate with complementary extensions provided on the top wall.

The connection end of the contact section may be provided with a connection end wall, for example folded substantially orthogonally from the top wall, in order to prevent material or objects from flowing or being inserted into the inner cavity area from a rear end of the terminal, thereby further protecting the contact arms. The connection end wall may also assist in rigidifying the box-shape of the contact section.

A connection end of the side walls may be further provided with secondary locking extensions having locking shoulders provided over a transition portion of the contact that interconnects the contact and connection sections, the transition portion having a width narrower than the contact section side walls such that space is provided for engagement of secondary locking shoulders of a connector housing behind the secondary locking extensions.

Further advantageous features of this invention will be set forth in the claims, or will be apparent from the following description and drawings.

DETAILED DESCRIPTION OF THE PREFERRED EMBODIMENT

Figure 1:
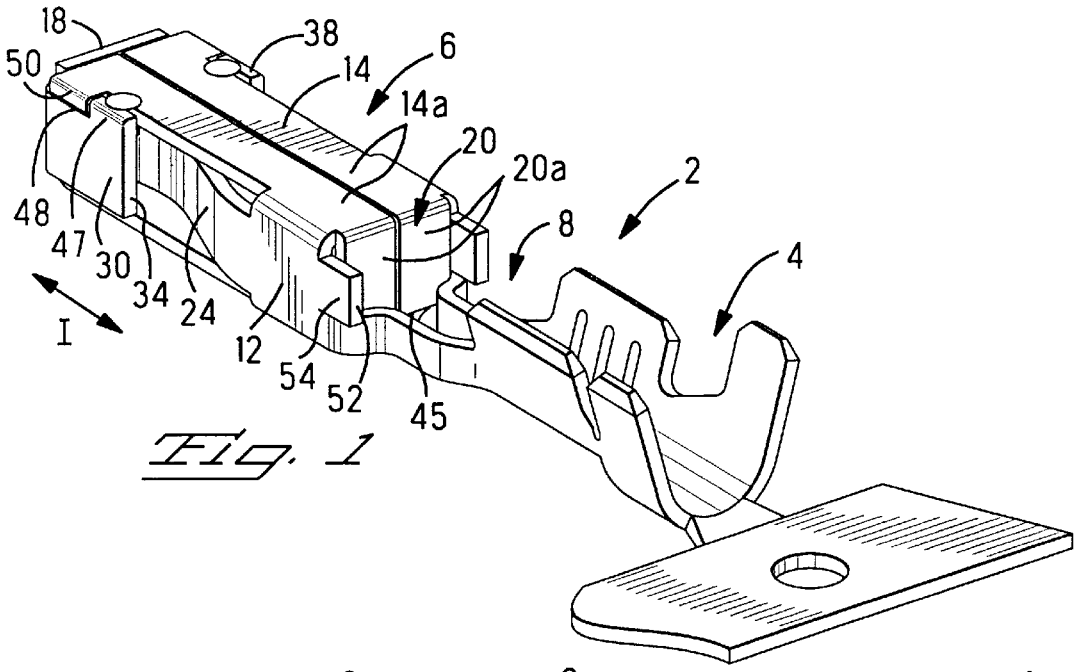
FIG. 1 is perspective view of a terminal according to this invention.

Referring to the figures, an electrical receptacle terminal 2 comprises a connection section 4 in the form of a crimping barrel for connection to a wire, and a contact section 6 attached to the connection section 4 via a transition section 8. The terminal 2 is stamped and formed from sheet metal, for example as illustrated in FIGS. 3–6, as a single piece terminal. The contact section 6 comprises a bottom wall 10, opposed side walls 12 extending substantially orthogonally from side edges 13 of the bottom wall, and a top wall 14 facing the bottom wall 10. The top, side and bottom walls form a box-shaped receptacle defining an inner cavity area 16 receiving a mating tab or pin contact section of a complementary terminal (not shown). The contact section 6 is further provided with a front or mating end wall 18 and a rear or connection end wall 20 positioned respectively at the mating end and connection end of the contact section 6. The mating end and connection end walls 18, 20 extend approximately perpendicularly to the insertion direction (I) of a mating pin terminal.

Figure 5:
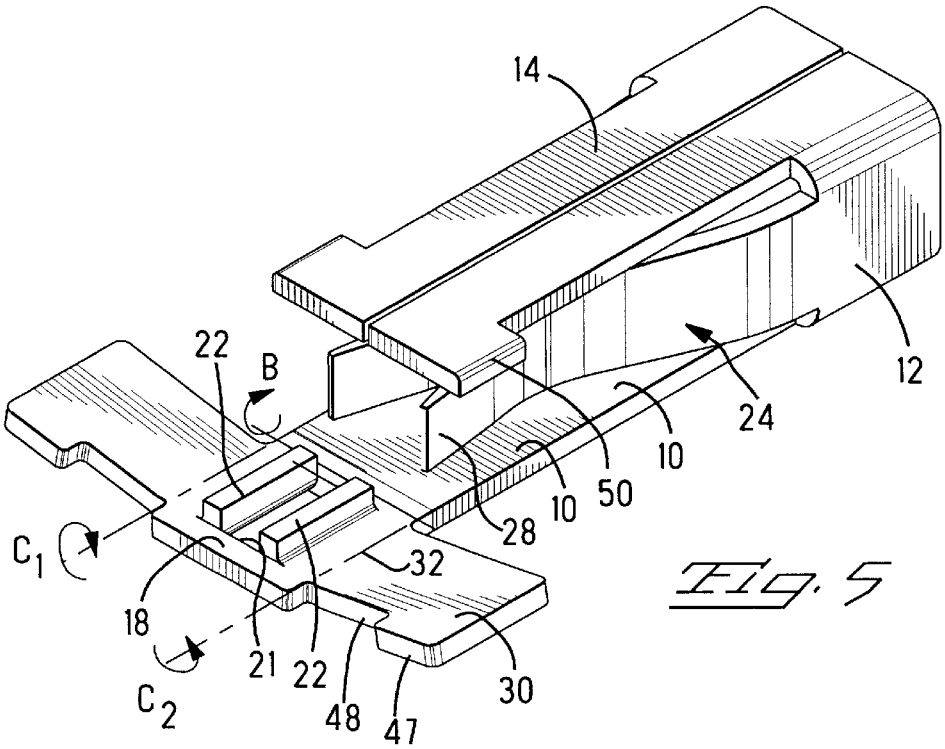
Figure 6:
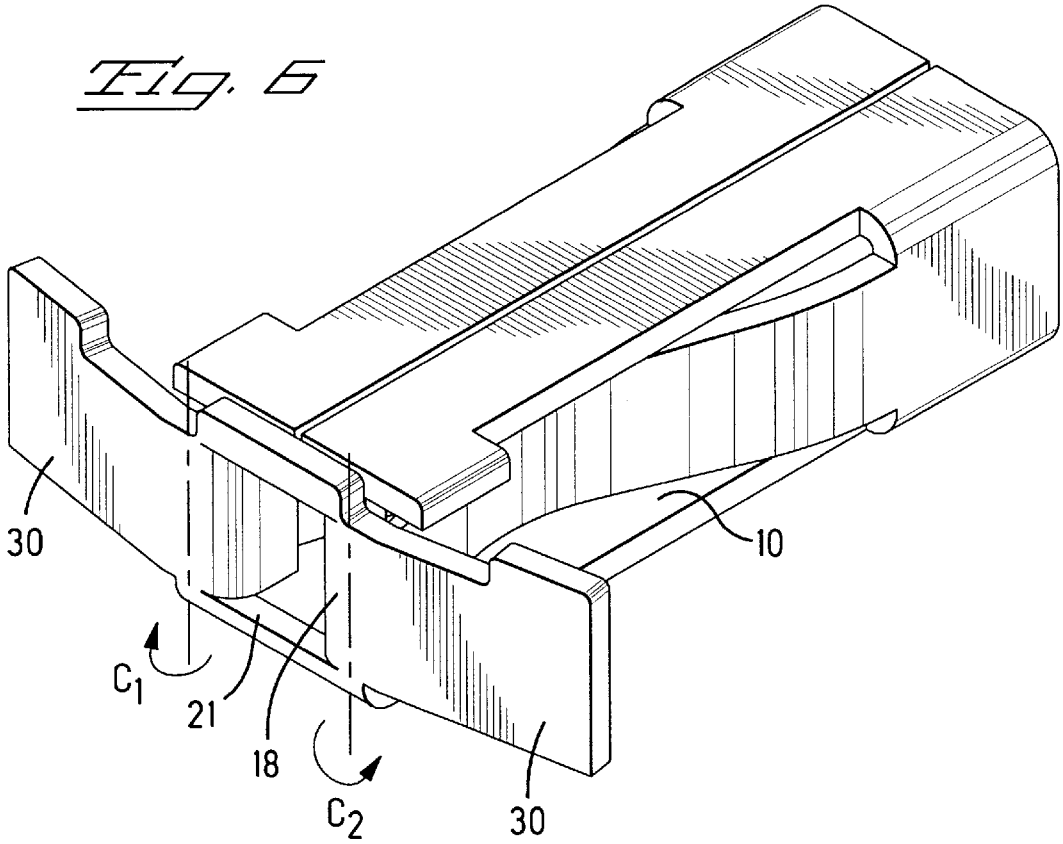

The mating end wall 18 is attached to and extends from the bottom wall 10 and is bent substantially 90° from the bottom wall as best seen when comparing FIGS. 5 and 6. The mating end wall 18 is further provided with a cutout 21 as best seen in FIGS. 5 or 6, formed by inwardly stamping extensions or ledges 22 (see FIGS. 2 or 5) that project roughly in the insertion direction (I).

Figure 2:
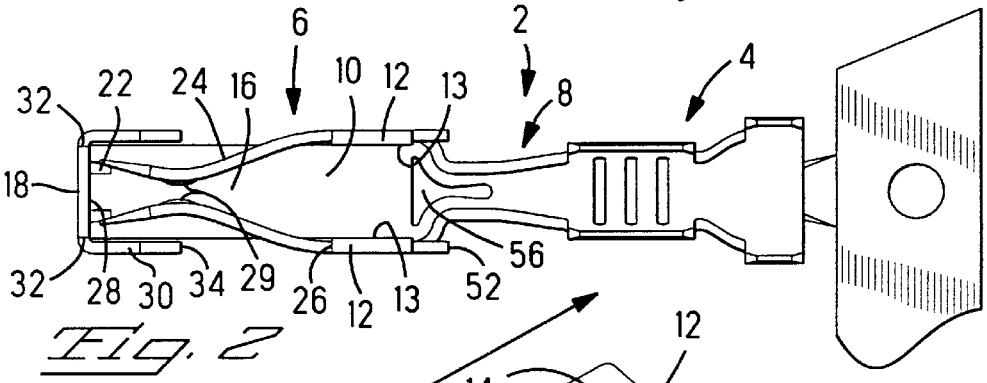
FIG. 2 is a top view of the terminal according to FIG. 1 with the top wall removed.

The contact section is further provided with a pair of opposed cantilever beam contact arms 24 extending from an attachment portion 26 proximate the connection section 4 to free ends 28 proximate the mating end wall 18. The contact arms 24 are integrally connected with the side walls 12 at the attachment portion 26 and converge into the inner cavity area 16 to contact portions 29 proximate the free ends 28. The free ends 28 resiliently abut against the inward extensions 22 of the mating end wall 18 such that the contact arms are in a pre-stressed condition, in order to increase the contact force against a mating pin terminal inserted between the contact portions 29. As best seen in FIGS. 2 and 5, the free ends 28 of the contact arms 24 may be coined (i.e. stamped thinner) in order to extend the length of the contact arms to enable engagement with ledges 22.

Figure 7:
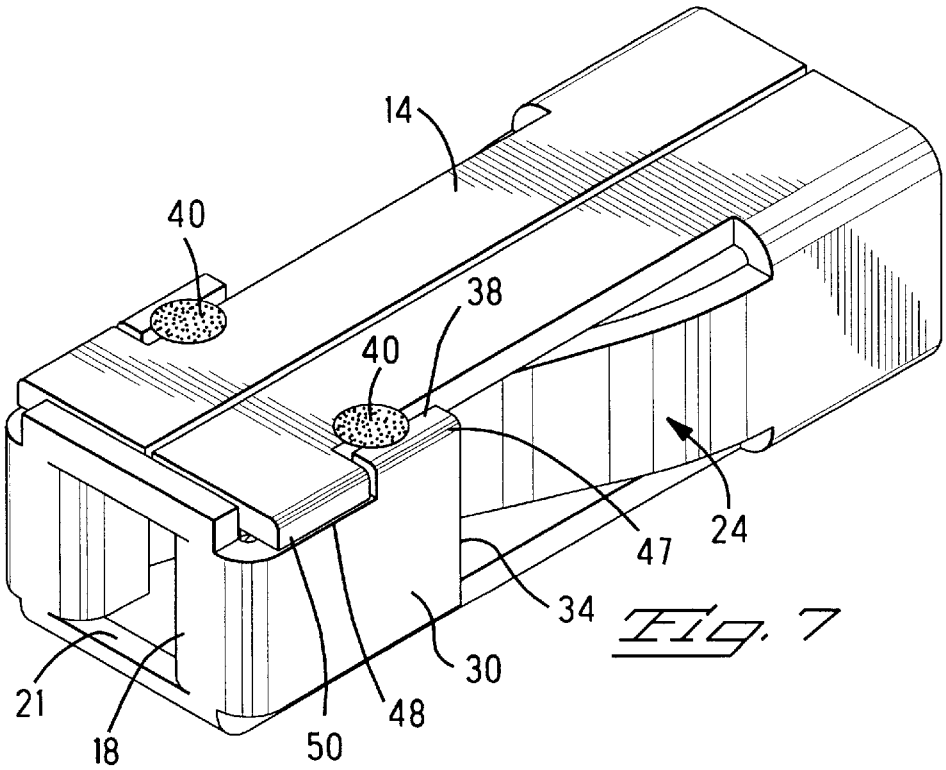
FIG. 7 is a perspective view of the contact section of the terminal.

The contact section 6 further comprises mating end side wall portions 30 that extend from side edges 32 of the mating end wall 18 and which are bent (in the direction of arrows C1 and C2 shown in FIGS. 4–6) substantially 20 orthogonally from the mating end wall 18, for approximate alignment with the side walls 12 as best seen when comparing FIGS. 6 and 7. The mating end side wall portions 30 are fairly short in comparison to the overall length of the contact section, a rear end 34 of the mating end side wall portions 30 being in the vicinity (with respect to the insertion direction (I)) of the contact portions 29 of the contacts 24. The rear end or edge 34 of the mating end side wall portions 30 forms a locking shoulder for engagement of a connector housing locking protrusion thereagainst in order to lock the terminals in connector housings. As the locking shoulder 34 is in the vicinity of the contact portions 29 which are the most inwardly biased portions of the contacts in the receptacle cavity 16, interference of the contact arms with the housing locking protrusion is avoided in a compact arrangement. In addition, the mating end side wall portions 30 provide protection for the contact arm free end and contact portions 28, 29. The mating end side wall portions 30 are attached to the top wall 14 (and could similarly be attached to the bottom wall 10) by welding a top (and/or bottom) edge 38 of the side wall portions to the top (and/or bottom) wall 14. The weld may for example be a laser generated spot weld 40.

Attachment of the mating end side wall portions 30 to the top and/or bottom walls provides for a rigid box-shape contact section with well protected contact portions 29 in a compact arrangement that requires particularly low material usage and wastage. This can be understood by viewing FIG. 3 which shows the planar layout of sheet metal stamped to form the various walls and contact arms, prior to the bending (forming) operations. The length of material L in the insertion direction (I) is particularly short, and the scrap material resulting from stamping out the arms and side walls (see spaces 33) is particularly low in view of the advantageous arrangement of contact arms 24, bottom 10, top 14, side 12, front 18 walls and mating end side wall portions 30 extending from side edges 32 of the mating end wall 18.

Figure 3:
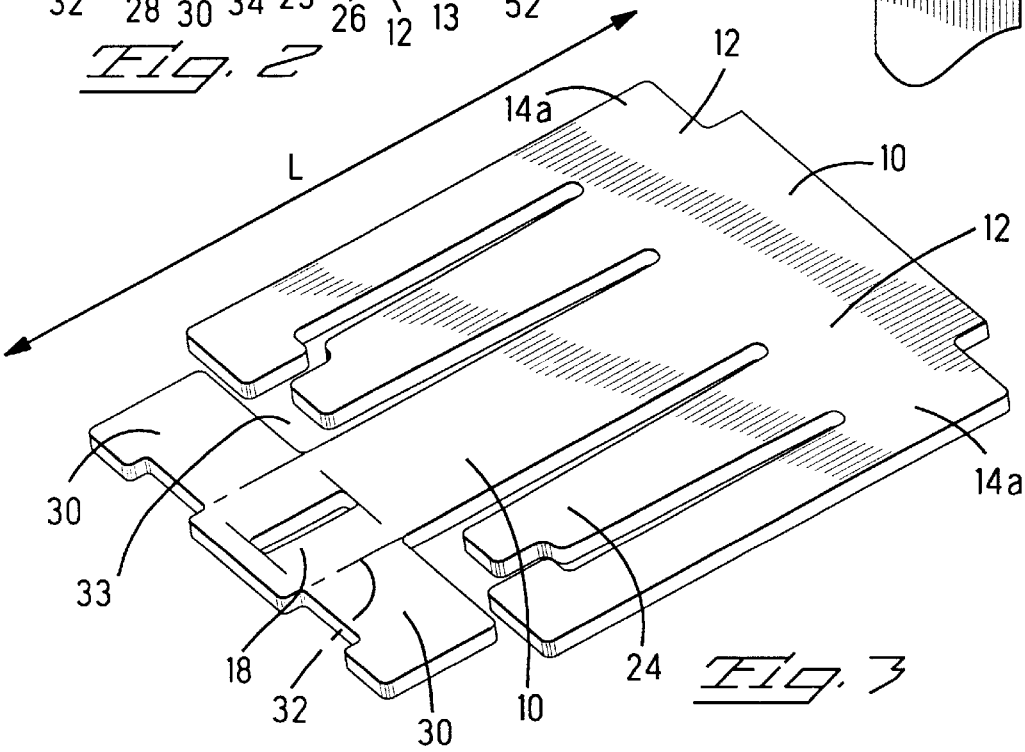
FIG. 3 is a perspective view of a stamped layout of a contact section of the terminal.
Figure 4:
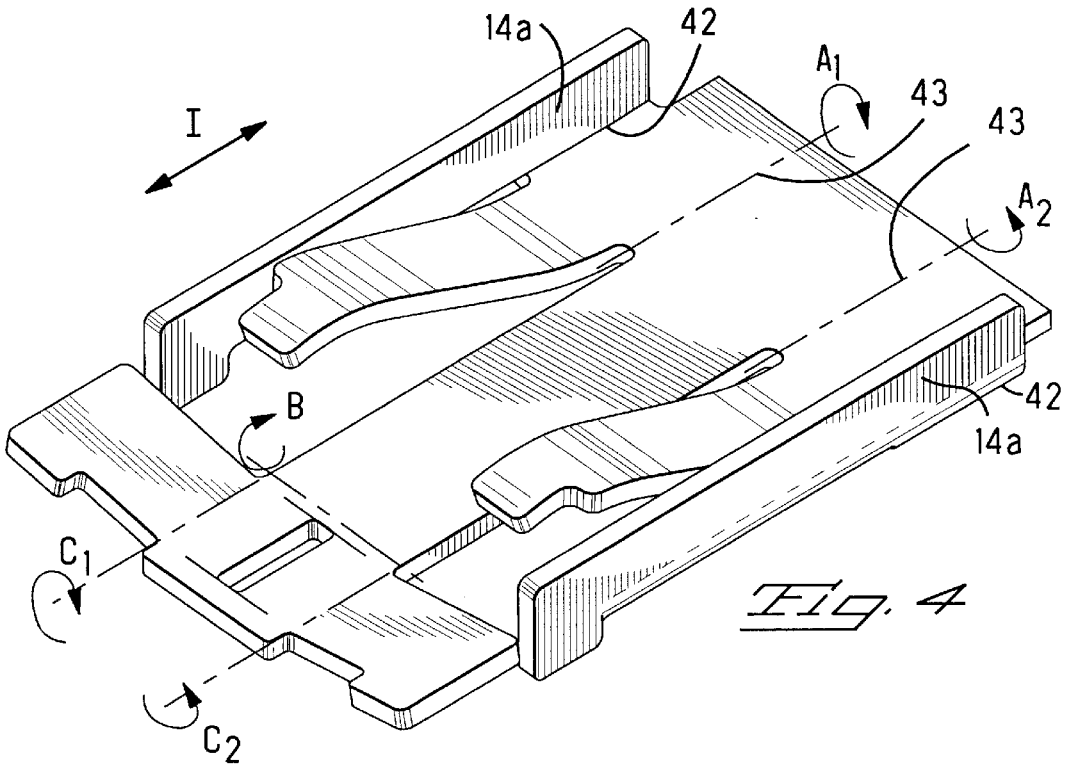
FIGS. 4, 5 and 6 are perspective views showing respectively successive stamping and forming steps of the contact section from the layout of FIG. 4.

From the layout shown in FIG. 3, the contact arms 24 are formed and top wall halves 14*a* are folded up along bend lines 42 parallel to the insertion direction (I) as shown in FIG. 4. Subsequently, as shown in FIG. 5, the side walls 12 are folded (in the direction of arrows A1 and A2 shown in FIG. 4) perpendicularly from the base wall 10 around bend lines 43 extending in the insertion direction (I). The contact pre-stressing ledges 22 may be folded from the mating end wall 18 in the steps shown in FIG. 4 or FIG. 5, simultaneously forming the terminal receiving cutout 20. The mating end wall 18 may then be folded (in the direction of arrow B shown in FIGS. 4 and 5) upwards from the bottom wall 10 as shown in FIG. 6 and subsequently the mating end side wall portions 30 folded into the side walls as shown in FIG. 7, and welded to the top and/or bottom walls. Whilst the connection end wall 20 is not shown in FIGS. 4–7, the connection end wall halves 20*a* may be folded down from the top wall halves 14*a* in the steps of FIGS. 6 or 7. After forming of the contact section 6, the transition and connection sections 4, 8 may be formed, the transition section 8 partially capturing the lower end 45 of the connection end wall 20 as best seen in FIG. 1.

The connection end wall 20 may serve to prevent matter from entering into the contact area from a rear end of the terminal for example during over-molding of the terminal with plastic or elastomeric material (for example for sealing purposes or assembly in insulative housing components). In addition, the connection end wall provides a further support for the box-shape contact section 6 to further enhance the robustness thereof.

The mating end side wall portions 30 are further provided with a recessed portion 48 in the upper edge 47 that receives a complementary extension 50 of the top wall 14 to form an interleaving extension arrangement as best seen in FIGS. 1 and 7. The interleaving extensions 47, 50 assist in securely holding the mating end wall 18 to the top wall as well as securing the mating end side wall portions 30 to the top wall to form a mating end box-shaped portion that is securely interlocked and held together.

The contact section is further provided with secondary locking shoulders 52 directed towards the connection section 4 and provided on extensions 54 of the side walls 12, for engaging a secondary locking member of a connector housing thereagainst. The secondary locking shoulders 52 are provided in a region (with respect to the insertion direction (I)) above the transition section 8 which is of a relatively small width compared to the contact section 6, such that a secondary locking member can be positioned behind the secondary locking shoulder 52. In order to slim down the transition section from the contact section sidewalls over a short distance (in the direction (I)) a cutout 56 is stamped out for the base wall of the contact section transition section.

Advantageously therefore, a particularly compact single piece electrical terminal with low material usage and wastage is provided in a robust and compact arrangement.

I/we claim:

1. A single piece electrical receptacle terminal for mating with a complementary tab or pin terminal, the terminal comprising a connection section, a transition section and a contact section having a contact body with top, side and bottom walls forming a box-shape that defines an inner cavity area for receiving the mating tab or pin terminal therein, the contact section further including contact arms that extend from the opposed side walls and have contact portions arranged proximate a mating end wall at a mating end of the terminal, the mating end wall is provided with a cutout for guiding and locating the mating tab or pin terminal into the inner cavity area and between the contact arms, wherein the side walls have mating end portions attached and extending from opposed side edges of the mating end wall and folded substantially orthogonally therefrom in order to be arranged along sides of the contact section, the mating end side wall portions including locking shoulders for locking the terminal in a connector housing, the locking shoulders positioned approximately over the contact portions of the contact arms, wherein the mating end side wall portions and top wall are provided with interlocking extensions.

2. The terminal of claim 1, wherein the mating end side wall portions are welded to the top wall.

3. The terminal of claim 1, wherein the bottom wall is provided with a cutout proximate the transition section to facilitate inward narrowing of side walls of the transition section, from the contact section side walls.

4. The terminal of claim 1, wherein the contact section comprises a connection end wall extending substantially perpendicularly to an insertion direction proximate the connection section.

5. The terminal of claim 4, wherein the connection end all has an end captured in a U-shaped transition section interconnecting the connection and contact sections.

6. The terminal of claim 5, wherein the connection end wall is folded from the top wall.

7. The terminal of claim 1, wherein the mating end wall comprises inwardly stamped ledges against which free ends of the contact arms resiliently abut for pre-stressing thereof.

8. The terminal of claim 7, wherein the free ends of the contact arms are coined in order to extend the length of the contact arms for engagement with the ledges.

9. The terminal of claim 7, wherein the mating end wall is folded substantially orthogonally from the bottom wall.

10. A single piece electrical receptacle terminal for mating with a complementary tab or pin terminal, the terminal comprising a connection section, a transition section and a contact section having a contact body with top, side and bottom walls forming a box-shape that defines an inner cavity area for receiving the mating tab or pin terminal therein, the contact section further including contact arms that extend from the opposed side walls and have contact portions arranged proximate a mating end wall at a mating end of the terminal, the mating end wall is provided with a cutout for guiding and locating the mating tab or pin terminal into the inner cavity area and between the contact arms, wherein the side walls have mating end portions attached and extending from opposed side edges of the mating end wall and folded substantially orthogonally therefrom in order to be arranged along sides of the contact section, the mating end side wall portions including locking shoulders for locking the terminal in a connector housing, the locking shoulders positioned approximately over the contact portions of the contact arms, wherein the mating end wall comprises inwardly stamped ledges against which free ends of the contact arms resiliently abut for pre-stressing thereof.

11. A single piece electrical receptacle terminal for mating with a complementary tab or pin terminal, the terminal comprising a connection section, a transition section and a contact section having a contact body with top, side and bottom walls forming a box-shape that defines an inner cavity area for receiving the mating tab or pin terminal therein, the contact section further including contact arms that extend from the opposed side walls and have contact portions arranged proximate a mating end wall at a mating end of the terminal, the mating end wall is provided with a cutout for guiding and locating the mating tab or pin terminal into the inner cavity area and between the contact arms, wherein the side walls have mating end portions attached and extending from opposed side edges of the mating end wall and folded substantially orthogonally therefrom in order to be arranged along sides of the contact section, the mating end side wall portions including locking shoulders for locking the terminal in a connector housing, the locking shoulders positioned approximately over the contact portions of the contact arms, wherein the bottom wall is provided with a cutout proximate the transition section to facilitate inward narrowing of side walls of the transition section, from the contact section side walls.

* * * * *